US005554047A

United States Patent [19]

Englert, Jr.

[11] Patent Number: 5,554,047

[45] Date of Patent: Sep. 10, 1996

[54] ELECTRICAL CONNECTOR WITH TERMINAL SUPPORTING WALLS

[75] Inventor: Michael W. Englert, Jr., Charlotte, N.C.

[73] Assignee: The Whitaker Corporation, Wilmington, Del.

[21] Appl. No.: 413,731

[22] Filed: Feb. 28, 1995

[51] Int. Cl.[6] ..... H01R 13/38

[52] U.S. Cl. ..... 439/405; 439/404; 439/417

[58] Field of Search ..... 439/400, 401, 439/404, 405, 417, 751

[56] References Cited

U.S. PATENT DOCUMENTS

| | | | |
|---|---|---|---|
| 4,153,325 | 5/1979 | Asick | 439/405 |
| 4,648,677 | 3/1987 | Lang | 439/404 |
| 4,897,041 | 1/1990 | Heiney et al. | 439/404 |
| 4,902,242 | 2/1990 | Davis et al. | 439/404 |
| 4,902,243 | 2/1990 | Davis | 439/405 |
| 5,064,383 | 12/1991 | Locati et al. | 439/405 |
| 5,104,336 | 4/1992 | Hatanaka et al. | 439/404 |
| 5,122,079 | 6/1992 | Locati | 439/417 |
| 5,125,850 | 6/1992 | Locati | 439/404 |
| 5,242,314 | 9/1993 | DiGiulio et al. | 439/404 |
| 5,326,286 | 7/1994 | Bixler et al. | 439/405 |
| 5,358,424 | 10/1994 | Bowen et al. | 439/405 |

FOREIGN PATENT DOCUMENTS

| | | |
|---|---|---|
| 0571156A2 | 11/1993 | European Pat. Off. . |
| 2051504A | 1/1981 | United Kingdom . |

OTHER PUBLICATIONS

International Search Report dated Apr. 24, 1996, PCT/US95/16564.

*Primary Examiner*—Gary E. Elkins
*Attorney, Agent, or Firm*—Anton P. Ness

[57] ABSTRACT

An electrical connector (1) comprises, a cable receiving face on an insulating housing (2), a cable engaging face on a termination cover (3), cavities (6) in the housing (2), each of the cavities (6) communicating with two slotted openings (12), electrical contacts (13) received in one or the other of the slotted openings (12), insulation displacement terminals (15) on adjacent contacts (13) being wider than spacing between the adjacent contacts (13), and opposite sides of the terminals (15) being confined between respective first and second walls (9, 10) to resist bending of the terminals (15).

17 Claims, 4 Drawing Sheets

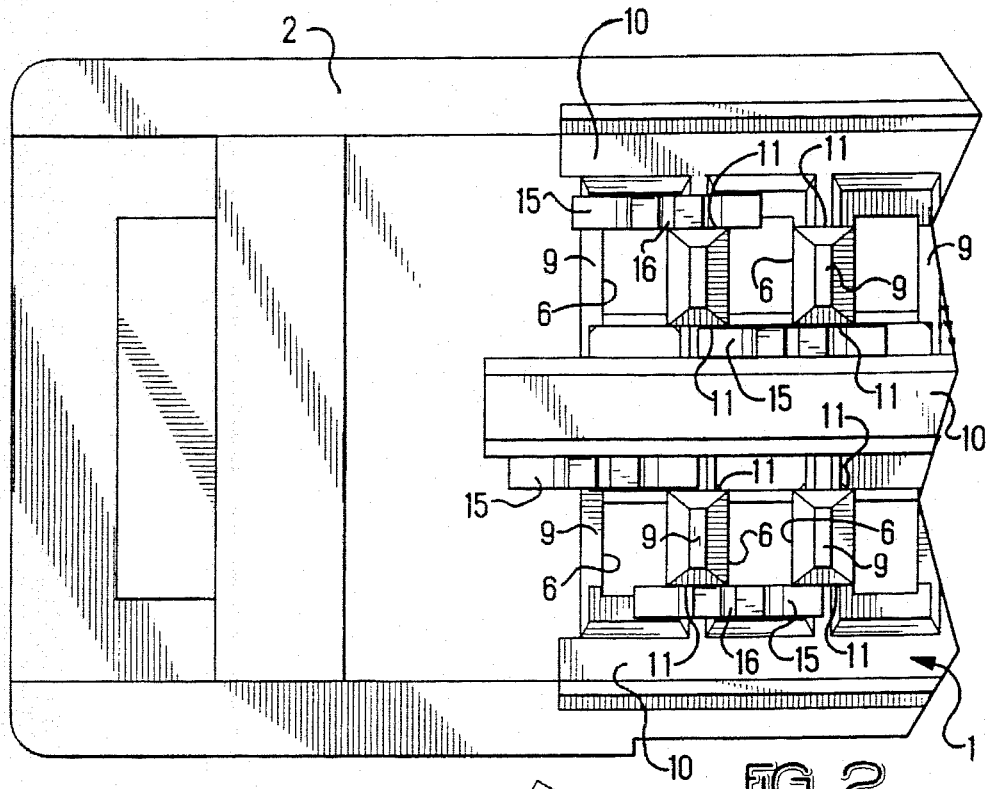
FIG. 2
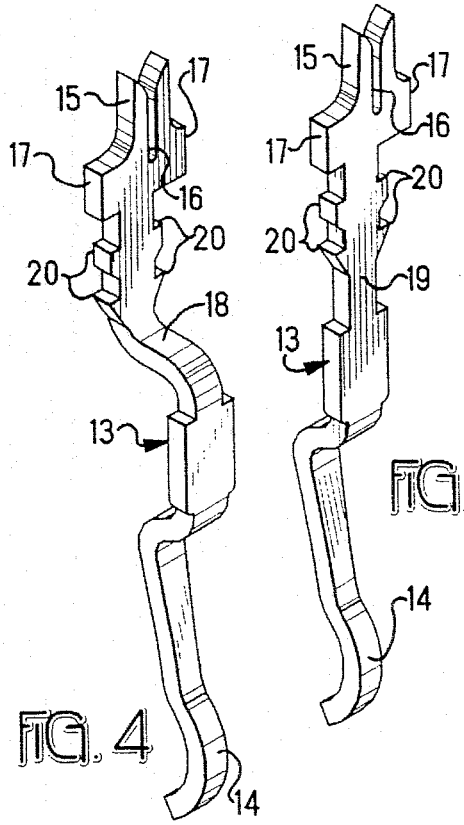
FIG. 3
FIG. 4

ELECTRICAL CONNECTOR WITH TERMINAL SUPPORTING WALLS

FIELD OF THE INVENTION

The invention relates to an electrical connector with insulation displacement terminals, and more particularly, to an electrical connector with insulation displacement terminals that are wider than spacing between adjacent contacts in the connector.

BACKGROUND OF THE INVENTION

U.S. Pat. No. 5,121,850 discloses an electrical connector comprising, an insulating housing and a termination cover that is moveable toward a cable receiving face on the housing. Electrical contacts are spaced apart in the housing. Insulation displacement terminals on respective contacts are spaced apart from one another. The contacts and the terminals are arranged in two rows. The terminals are the widest portions of respective contacts. The contacts must be spaced apart to prevent electrical shorting between adjacent terminals. Accordingly, the width of the terminals determine how closely spaced the contacts can be adjacent to one another.

As disclosed in U.S. Pat. No. 5,122,079, the contacts can be spaced closer together, even when the terminals are wider than the spacing between the contacts. The terminals on contacts in one row of contacts are alternately positioned along opposite sides of a channel shaped opening. Thus, two rows of terminals extend from one row of contacts. The terminals are alternately spaced apart to prevent electrical shorting between adjacent contacts in the same row of contacts. It has been observed that the terminals are susceptible to undesired misalignment and undesired bending within the channel shaped opening, especially during penetration of the terminals into a cable for electrical connection of the terminals to the cable. Once the cable is clamped between the cover and the housing, the terminals are hidden. A misaligned or bent terminal could produce a defective electrical connection. Heretofore, the terminals were installed in the housing, and a separate insulator was assembled to surround the terminals. The separate part increased the cost of the connector, and required an extra assembly step.

SUMMARY OF THE INVENTION

A feature of the invention resides in a housing that resists bending of two rows of terminals that extend from one row of electrical contacts. The housing eliminates the need for a separate insulator to surround the terminals.

According to an embodiment, a housing is constructed such that contact receiving cavities communicate with two slotted openings, an electrical contact in each of the cavities extends along one or the other of the slotted openings, projecting walls on the housing extend rearward of the slotted openings, a terminal on the contact is wider than the spacing between adjacent cavities, the terminal is received in slotted spaces between the projecting walls, and opposite sides of the terminal are confined between respective projecting walls to resist bending of the terminal.

DESCRIPTION OF THE DRAWINGS

An embodiment of the invention will now be described by way of example with reference to the accompanying drawings, according to which:

FIG. 2 is an end view of the connector shown in FIG. 1, with parts cut away;

FIG. 3 is an isometric view of an electrical contact in the connector shown in FIG. 1;

FIG. 4 is an isometric view of another electrical contact in the connector shown in FIG. 1;

DETAILED DESCRIPTION

Figure 1:
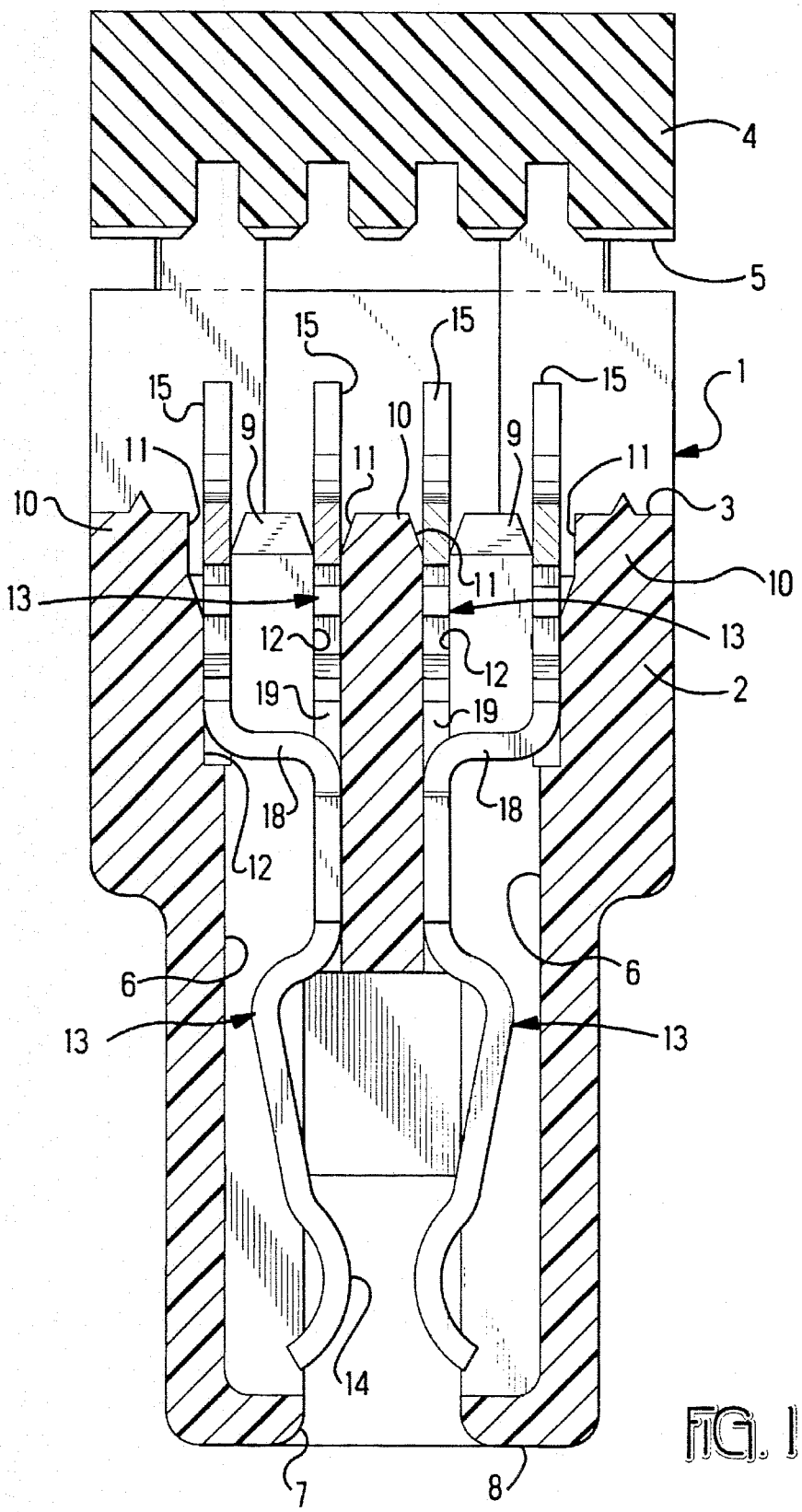
FIG. 1 is a cross section view of an electrical connector as shown in U.S. Pat. No. 5,122,079, together with a feature of the invention not present in the connector of said Patent.

With reference to the drawings, an electrical connector 1 comprises an insulating housing 2, a first or cable receiving face 3 on a rear of the housing 2, a termination cover 4, FIG. 1, and a cable engaging face 5 on the cover 4, the cover being moveable toward the cable engaging face 3 to terminate and clamp an electrical cable, not shown. Further details of the connector 1 are disclosed in the aforementioned U.S. Pat. No. 5,122,079.

Figure 5:
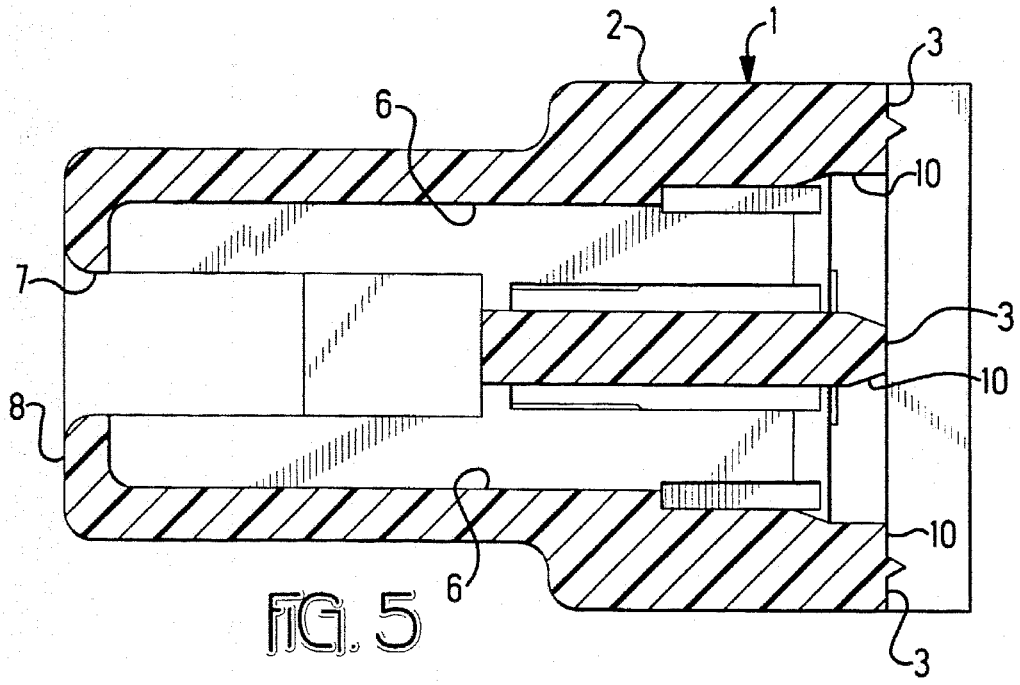
FIG. 5 PRIOR ART
FIG. 5 is an enlarged cross section of a Prior Art housing of the electrical connector as shown in U.S. Pat. No. 5,122,079.
Figure 6:
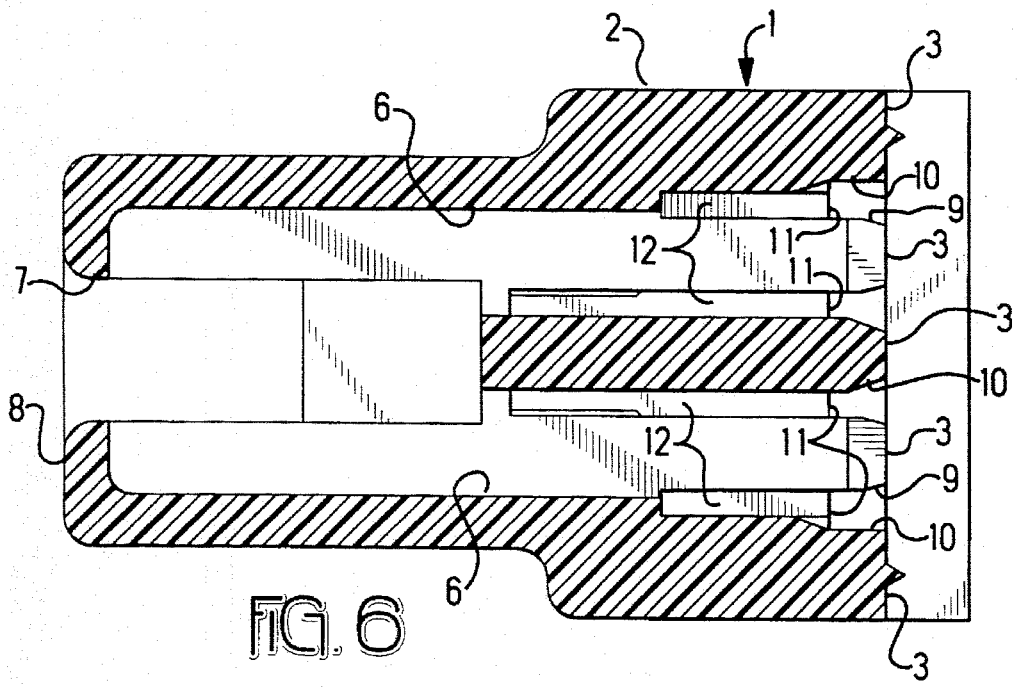
FIG. 6 is an enlarged cross section of a housing of the electrical connector as shown in FIG. 1.
Figure 7:
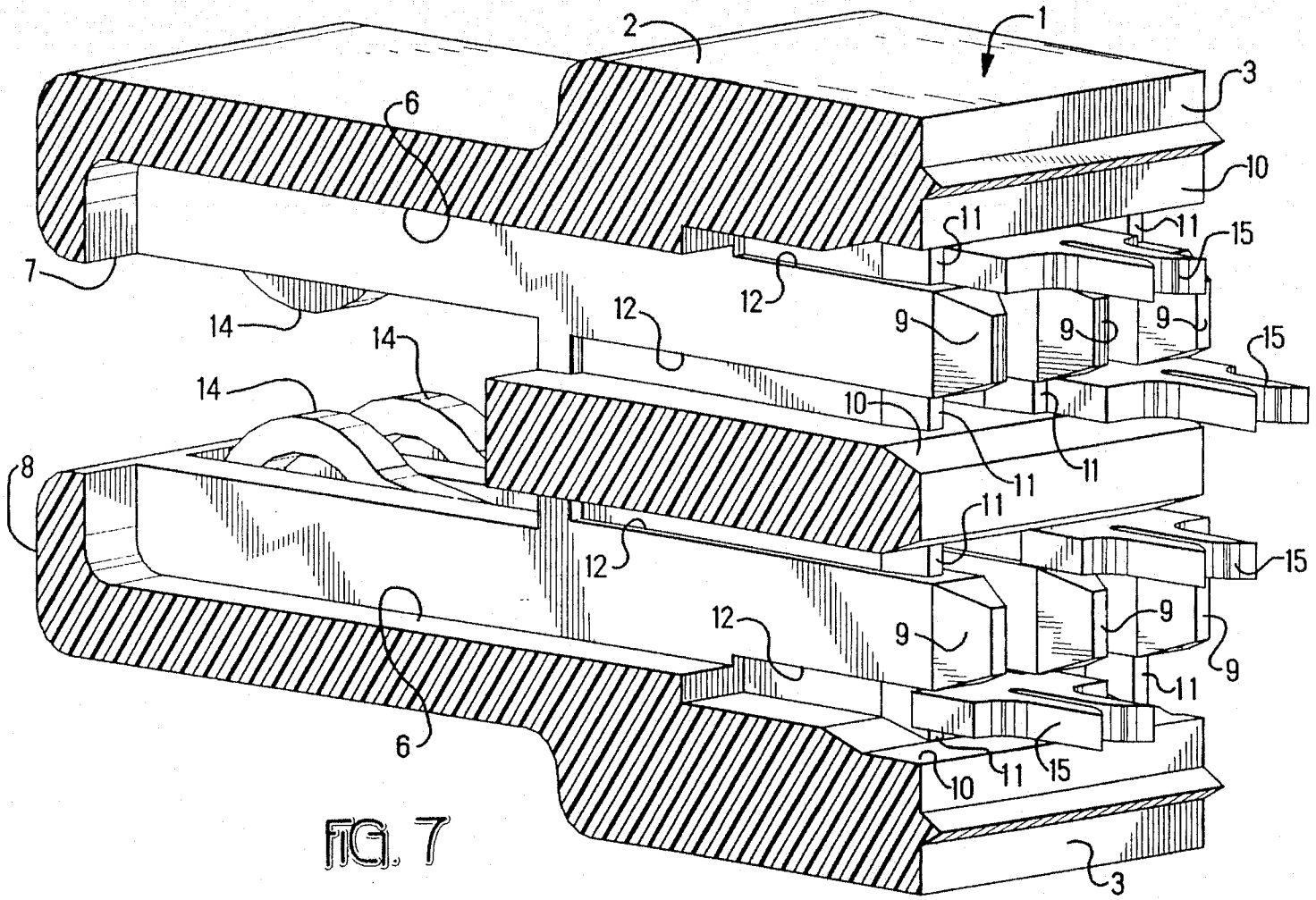
FIG. 7 is an enlarged isometric view of the connector shown in FIG. 1 with parts cut away.

The connector 1 further comprises, multiple contact receiving cavities 6 in the housing 2, the cavities 6 being arranged in two rows, FIGS. 1, 5 and 6. Adjacent cavities 6 are in the same row of cavities 6, as shown in FIG. 2. An open mouth 7 in a second face or mating front end 8 of the connector 1 communicates with each of the cavities 6. First projecting walls 9 are unitary with the housing 2 and separate adjacent cavities 6 from each other, FIGS. 1, 2 and 6, with additional walls 9 being beside cavities 6 that are at the ends of each of the rows of the cavities 6. The walls 9 extend to the cable receiving face 3, as shown in FIG. 6. FIG. 5 illustrates a housing 1 without the walls 9. Second projecting walls 10 are unitary with the housing 2, and extend along opposite sides of cavities 6. The walls 10 extend to the cable receiving face 3. The cable receiving face 3 is distributed over and along rear ends of the respective walls 10 and rear ends of the respective walls 9, FIG. 6. The walls 10 extend along both sides of the rows of the contacts 13, and extend transversely with respect to the walls 9.

With reference to FIGS. 1, 2, 6 and 7, slotted spaces 11 are at opposite ends of each of the walls 9. The slotted spaces separate the walls 9 from the walls 10. The slotted spaces 11 extend alongside the walls 10. The slotted spaces extend between respective walls 10 and respective walls 9. Each of the cavities 6 communicates with two, spaced apart, slotted openings 12. The slotted openings 12 communicate with respective slotted spaces 11.

With respect to the FIGS. 1, 3, 4 and 7, electrical contacts 13 are stamped and formed from thin metal strip having a plane of thickness. A curved contact portion 14 at a front of each contact 13 is received in a corresponding cavity 6. A rearward contact section or insulation displacement terminal 15 on a rear, thin plate of each contact 13 comprises, an insulation displacement slot 16 between flanges 17 extending in a plane of thickness of the thin plate of the contact 13. The flanges 17 define a width of the terminal 15 that is wider than the spacing between adjacent cavities 6. Adjacent cavities 6 are in the same row of cavities and are on opposite sides of a common wall 9.

Each contact 13 is constructed with one of two shapes. One shape, FIG. 4, on one of the contacts 13 comprises an offset bent portion 18 to extend the terminal 15 along a first of the slotted openings 12 when the contact 13 is inserted into a corresponding cavity 6. The other shape comprises an unbent portion 19, instead of the bent portion 18, to extend the terminal 15 along a second of the slotted openings 12. Barbs 20 on a portion of each contact 13 project in the plane of thickness of the contact 13. The barbs 20 engage opposite interior sides of the corresponding slotted opening 12, thereby to lock the contact 13 to the housing 2. Adjacent cavities 6 contain adjacent contacts 13. The terminals 15 on the adjacent contacts 13 are wider than the spacing between the adjacent contacts 13. The adjacent contacts 13 comprise the two contacts 13 of different shape. The terminals 15 on the adjacent contacts 13 extend to two different rows of the terminals 15, thereby to prevent electrical shorting of the terminals 15.

The widths of the slotted spaces 11 are slightly wider than the plane of thickness of a corresponding terminal 15. Opposite sides of each terminal 15 are confined in a corresponding slotted space 11, FIGS. 1, 2, and 7. Opposite sides of the terminal 15 are confined between respective projecting walls 9 and 10. The adjacent terminals 15 on the adjacent contacts 13 are overlapped by the same one of said projecting walls 9 to resist bending of said adjacent terminals 15. Accordingly, the walls 9 and 10 resist bending of the terminal 15.

An advantage of the invention resides in an electrical connector comprising a housing that eliminates the need for a separate insulator to surround the terminals to resist bending of the terminals.

What is claimed is:

1. An electrical connector comprising:

a first face on an insulating housing, cavities in the housing, each of the cavities communicating with two slotted openings, and wherein:

an electrical contact in each of the cavities extends along one or the other of the slotted openings, projecting walls on the housing extend rearward of the slotted openings, a rearward contact section is received in slotted spaces between the projecting walls, and opposite sides of the rearward contact section are confined between respective projecting walls to resist bending of the terminal.

2. An electrical connector as recited in claim 1, and further comprising: a thin plate on each rearward contact section, each plate having a plane of thickness, an insulation displacement slot in an end of the thin plate, and flanges being on the thin plate and projecting in the plane of thickness.

3. An electrical connector as recited in claim 1 wherein, said cavities extend transversely between first ones of said projecting walls, and second ones of said projecting walls extend transversely between said first ones of said projecting walls.

4. An electrical connector as recited in claim 3 wherein, the first face is distributed along each of the projecting walls.

5. An electrical connector as recited in claim 3 wherein, the slotted openings are at opposite ends of each of said first projecting walls.

6. An electrical connector as recited in claim 1 wherein, rearward contact sections of pairs of adjacent ones of said contacts are overlapped by the same one of said projecting walls to resist bending of said rearward contact sections.

7. An electrical connector as recited in claim 1 wherein, said rearward contact section is wider than the spacing between adjacent cavities.

8. An electrical connector as recited in claim 1, wherein first ones of said contacts include an offset bent portion forwardly of said rearward contact section thereof to align said rearward contact section with one of said slotted openings for insertion thereinto, and second ones of said contacts include an unbent portion forwardly of said rearward contact section thereof to align said rearward contact section with the other of said slotted openings.

9. An electrical connector as recited in claim 8 wherein, the rearward contact sections of said first and second contacts are overlapped by the same one of said projecting walls to resist bending of said rearward contact sections.

10. An electrical connector as recited in claim 1 wherein, a cable termination cover is adapted to be secured to said first face to clamp an electrical cable along said first face, maintaining conductors of the cable in said insulation displacement slots of respective said rearward contact sections.

11. An electrical connector comprising: a cable receiving face on an insulating housing, a cable engaging face on a termination cover, the cover being movable toward the cable receiving face, electrical contacts in respective cavities in the housing, each of the cavities communicating with two slotted openings, each of the contacts being received in a respective one of the slotted openings, insulation displacement terminals on adjacent contacts being wider than spacing between the adjacent contacts, first projecting walls on the housing between the adjacent contacts, second projecting walls extending transverse to the first projecting walls, and opposite sides of the terminals being confined between respective first and second walls to resist bending of the terminals.

12. An electrical connector as recited in claim 11 wherein, said cavities extend transversely between first ones of said projecting walls, and second ones of said projecting walls extend transversely between said first ones of said projecting walls.

13. An electrical connector as recited in claim 12 wherein, the cable receiving face is distributed along each of the projecting walls.

14. An electrical connector as recited in claim 11 wherein, the slotted spaces are at opposite ends of each of said first projecting walls.

15. An electrical connector as recited in claim 11 wherein, terminals of a pair of adjacent ones of said contacts are overlapped by the same one of said projecting walls to resist bending of said terminals.

16. An electrical connector comprising:

a cable receiving face on an insulating housing, a cable engaging face on a termination cover, the cover being movable toward the cable receiving face, cavities in the housing in adjacent associated pairs within common rows thereof, each cavity of a said pair being in communication with two slotted openings extending therebetween, adjacent contacts in respective ones of said adjacent cavities, projecting walls on the housing between adjacent cavities in the same row of cavities, a first terminal on one of the adjacent contacts, the first terminal being in one of said slotted openings, a second terminal on another of the adjacent contacts, the second terminal being in a second of said slotted openings, the first and second terminals being overlapped by the same one of said projecting walls to resist bending of said terminals.

17. An electrical connector as recited in claim 16 wherein, the slotted openings extend at opposite ends of each of said projecting walls.

* * * * *